US006155877A

United States Patent [19]

Yu et al.

[11] Patent Number: 6,155,877

[45] Date of Patent: Dec. 5, 2000

[54] ELECTRICAL CARD CONNECTOR

[75] Inventors: Hung-Chi Yu, Hsi-Chih, Taiwan; Tomohisa Hara, Nagano, Japan

[73] Assignee: Hon Hai Precision Ind. Co., Ltd., Taipei Hsien, Taiwan

[21] Appl. No.: 09/405,285

[22] Filed: Sep. 23, 1999

[30] Foreign Application Priority Data

Dec. 18, 1998 [TW] Taiwan ..... 87221143

[51] Int. Cl.[7] ..... H01R 13/648

[52] U.S. Cl. ..... 439/607

[58] Field of Search ..... 439/607–610, 439/101, 108, 92, 95, 76.1

[56] References Cited

U.S. PATENT DOCUMENTS 5,725,394 3/1998 Banakis et al. ..... 439/607

5,807,137 9/1998 Janota et al. ..... 439/607

5,901,049 5/1999 Schmidt et al. ..... 439/92

5,967,845 10/1999 Ho et al. ..... 439/607

*Primary Examiner*—Gary F. Paumen

*Attorney, Agent, or Firm*—Wei Te Chung

[57] ABSTRACT

An electrical card connector includes a pair of frames, a header and a shielding plate. A number of passageways are formed in the header for receiving terminals therein. A pair of receiving holes is formed proximate opposite distal ends of the header. The shielding plate has a base and a pair of locking arms. The locking arms extend from opposite distal ends of the base and are inserted into the receiving holes and then folded to shroud the header. Thus, the shielding plate protects the terminals positioned in the header from EMI.

3 Claims, 5 Drawing Sheets

ELECTRICAL CARD CONNECTOR

BACKGROUND OF THE INVENTION

The present invention relates to an electrical card connector, and particularly to an electrical card connector having a header and a shielding plate for protecting the header from EMI.

Electrical cards are widely used in the electronics industry to expand the memory and function of electronic devices. Electromagnetic interference (EMI) emanating from other components of the device acts on the electrical card. To minimize EMI, a conventional design employs a metal shield mounted on a top surface of a header section of the electrical card connector. Related examples are disclosed in U.S. Pat. No. 5,725,394 and Taiwan Patent Application No. 84112508. Since the conventional metal shielding plate of the electrical card connector only covers top surface of the electrical card connector header, a sufficient shielding function is not provided.

BRIEF SUMMARY OF THE INVENTION

A main object of the present invention is to provide a shielding plate for protecting an electrical card connector from EMI.

To fulfill the above mentioned object, an electrical card connector comprises a header, a pair of frames, a plurality of terminals and a shielding plate. A pair of receiving holes is formed proximate distal ends of the header. The shielding plate has an elongate base and a pair of locking arms extending from lateral ends of the base. The locking arms extend through the receiving holes and shroud the header for shielding the terminals from EMI.

Other objects, advantages and novel features of the invention will become more apparent from the following detailed description when taken in conjunction with the accompanying drawings.

DETAILED DESCRIPTION OF THE INVENTION

Figure 1:
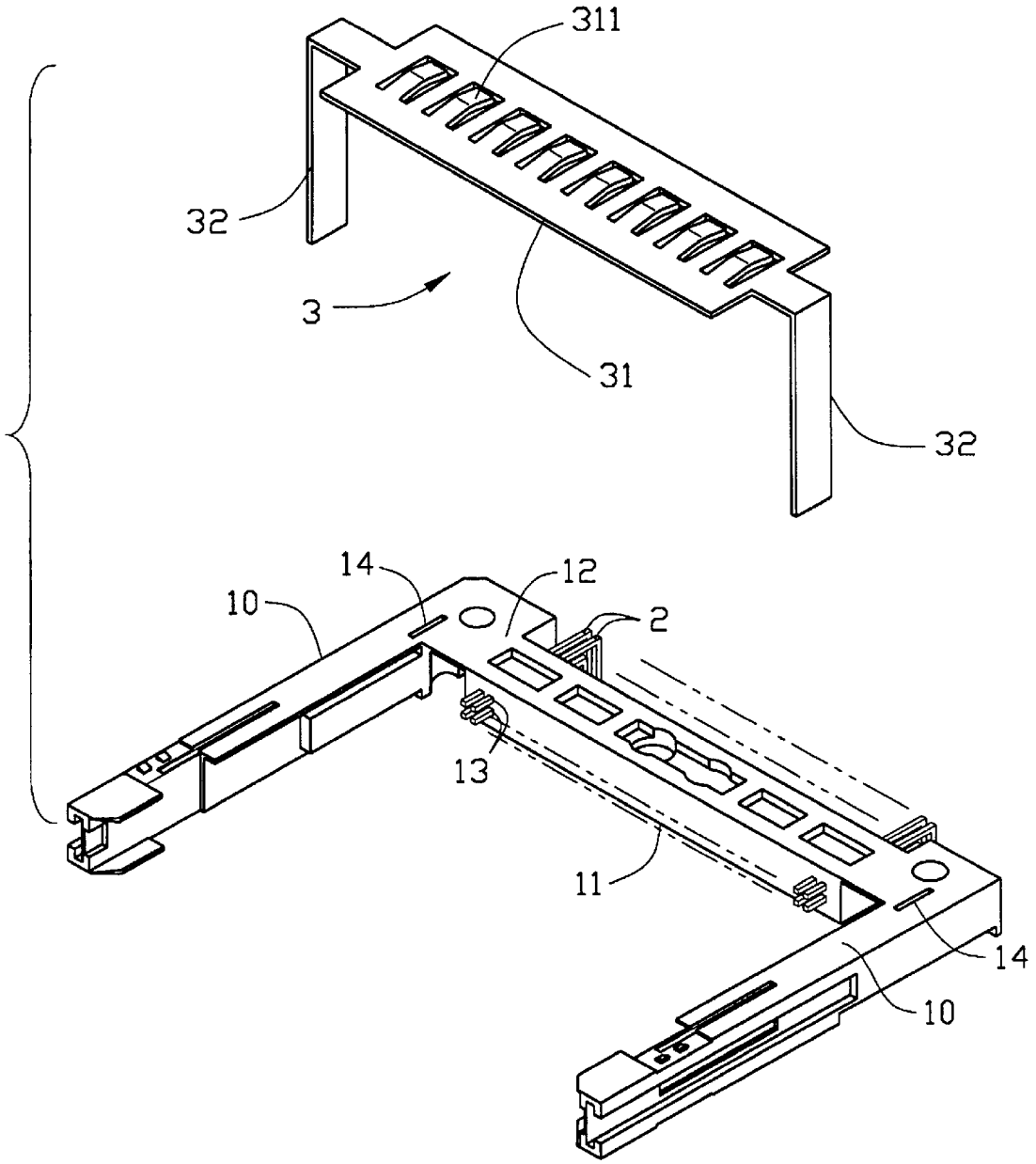
FIG. 1 is a perspective view of an electrical card connector and a shielding plate in accordance with the invention.

Referring to FIG. 1, an electrical card connector comprises a pair of frames 10, a header 12, and a shielding plate 3. A plurality of passageways 13 is defined in a body of the header 12 for receiving terminals 2 therein. A pair of receiving holes 14 is formed proximate opposite distal ends of the header 12. The shielding plate 3 has a base 31 and a pair of locking arms 32 extending from opposite distal ends of the base 31 for insertion through the holes 14. A plurality of bent fingers 311 is formed in the base 31 for electrically contacting an external metal shell (not shown) for grounding static electricity accumulated on the electrical card connector.

Figure 2A:
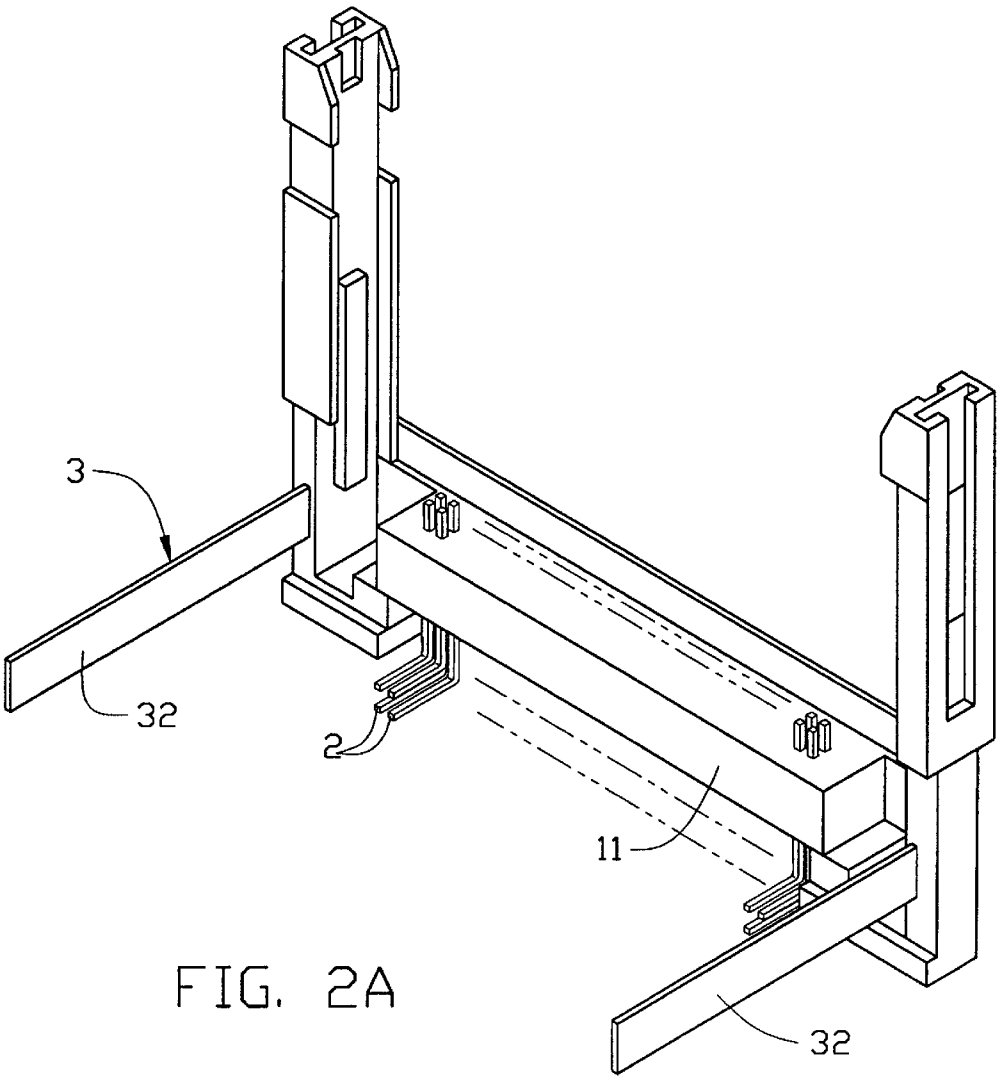
FIG. 2A is a perspective view showing the shielding plate partially assembled to the electrical card connector.
Figure 2B:
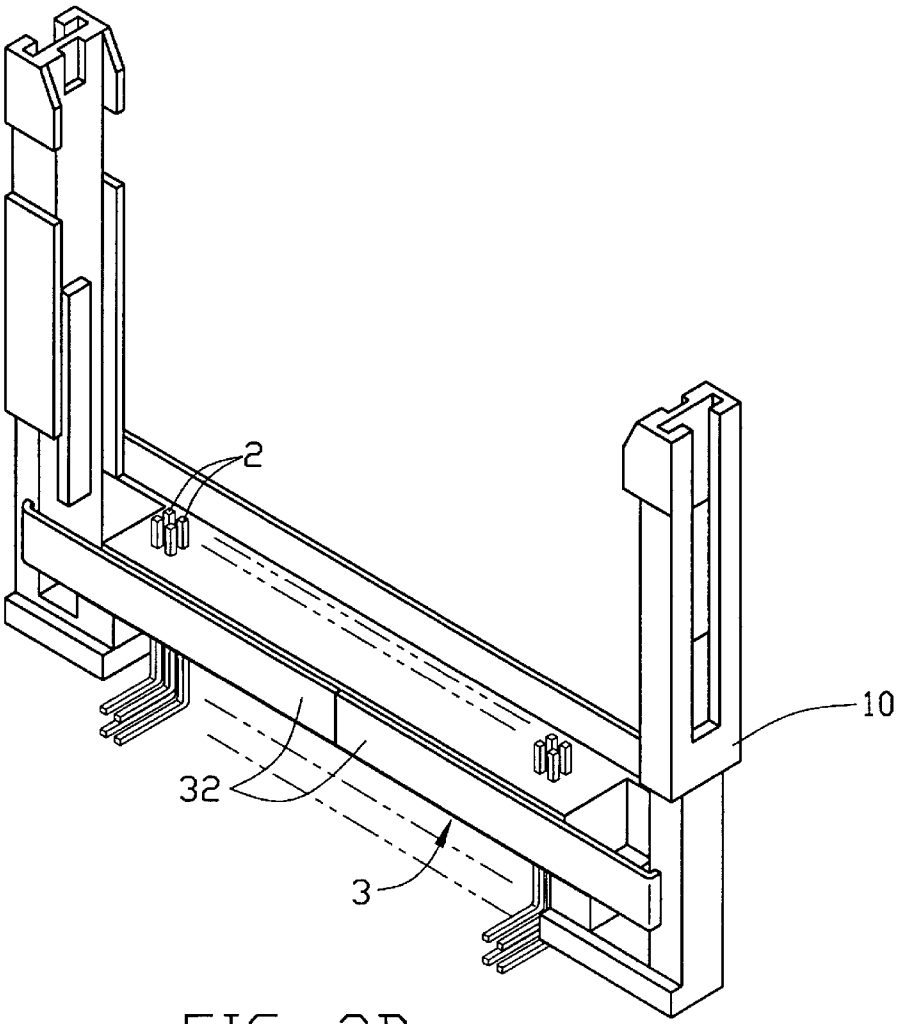
FIG. 2B is a perspective view of the fully assembled electrical card connector and shielding plate of FIG. 2A.

Referring to FIGS. 2A and 2B, in assembly, the two locking arms 32 of the shielding plate 3 are inserted through the receiving holes 14 and folded to cover a body surface 11 of the header 12. The locking arms 32 contact each other at free ends thereof and the shielding plate 3 also shrouds the header 12. Thus, the shielding plate 3 provides a better shielding function than the conventional design.

Figure 3A:
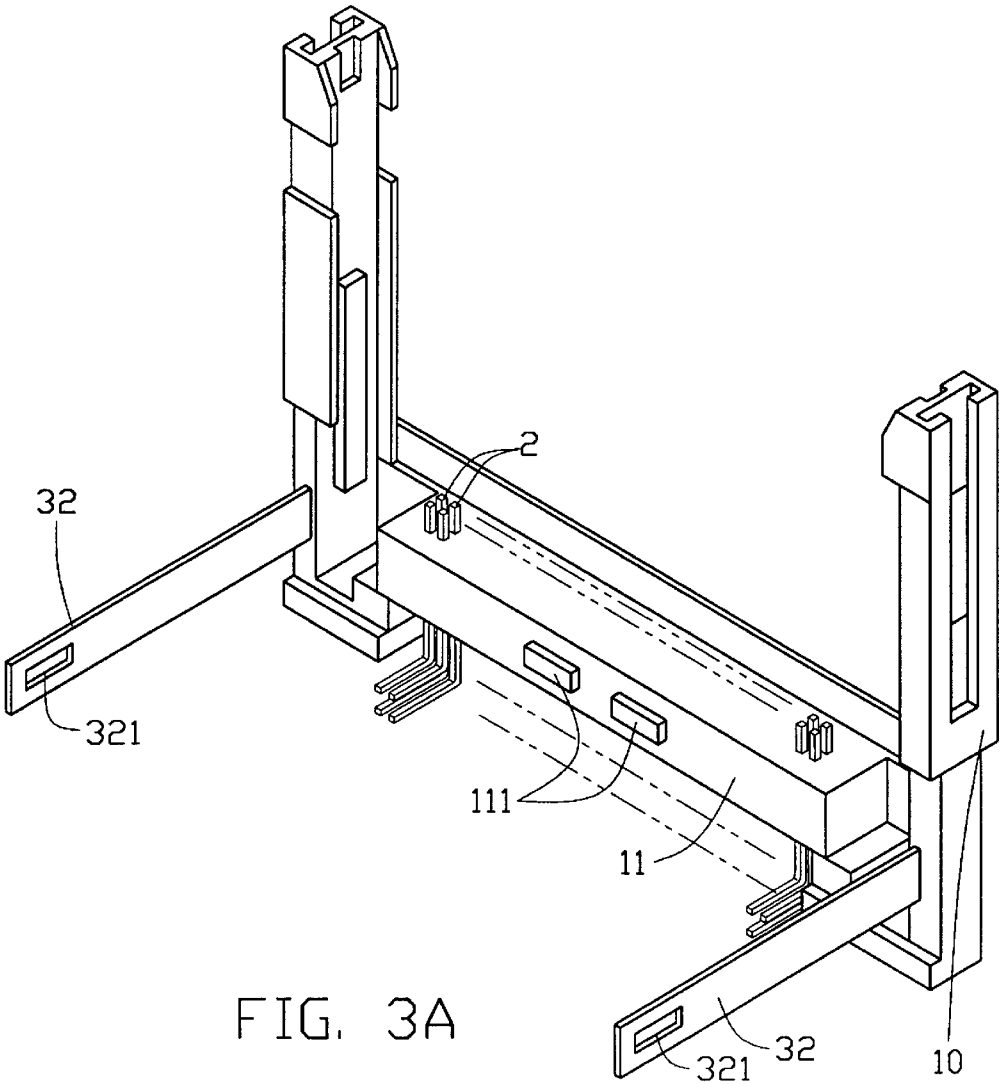
FIG. 3A is a perspective view showing an alternative embodiment of a shielding plate partially assembled to the electrical card connector.
Figure 3B:
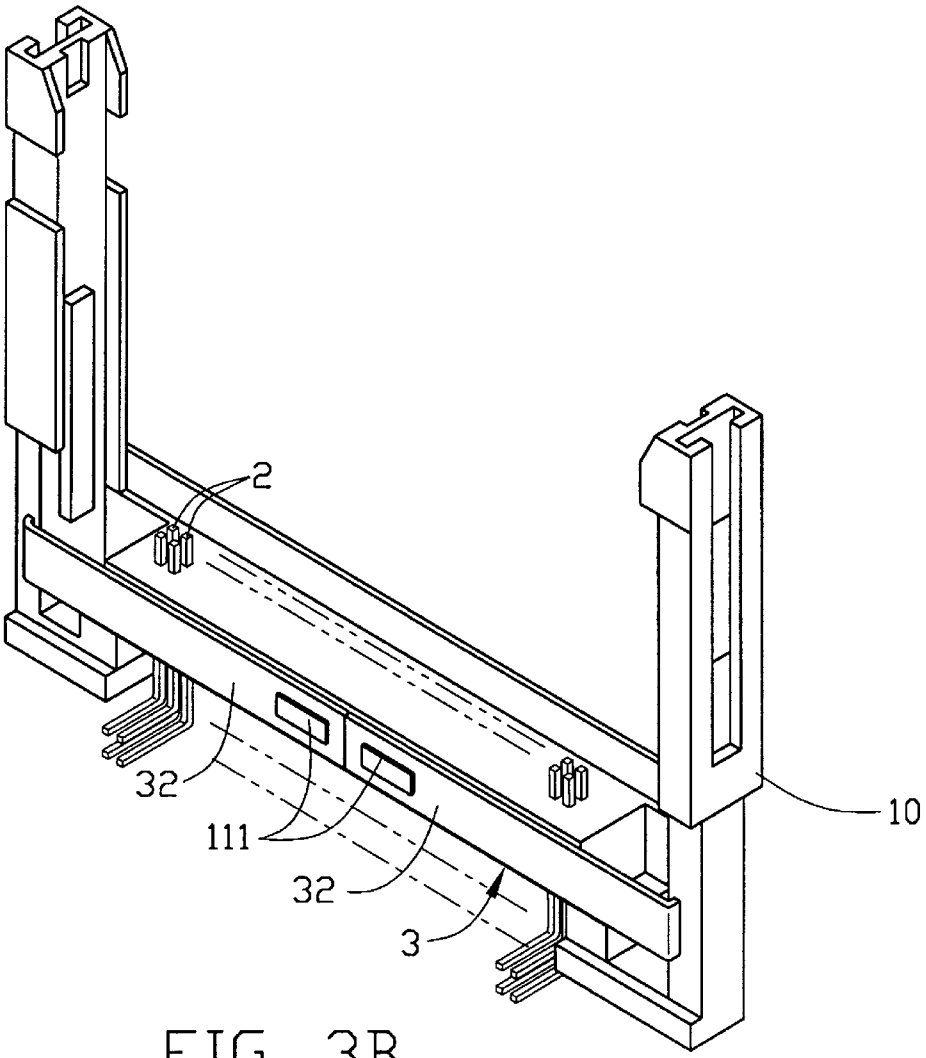
FIG. 3B is a perspective view of the assembled electrical card connector and shielding plate of FIG. 3A.

FIGS. 3A and 3B show an alternative embodiment of the present invention. A locking hole 321 is formed proximate a free end of each locking arm 32. Two projections 111 are formed on the body surface 11 corresponding to the locking holes 321. In assembly, the locking arms 32 are folded and the locking holes 321 engage with the projections 111. Thus, the shielding plate 3 shrouds the header 12 and protects the terminals 2 received in the header 12 from EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

a header comprising a plurality of passageways formed in a body thereof, one or more rows of terminals received in the passageways., and a pair of receiving holes formed on two distal ends thereof; and a shielding plate having a base and two locking arms extending from opposite distal ends of the base, the locking arms being inserted through the receiving holes and folded to shield the body of the header and being situated over substantially the entire length of one side of the one or more rows of terminals;

wherein a locking hole is formed proximate a free end of each locking arm, and two projections are formed on a surface of the header for engaging with the corresponding locking holes;

wherein a plurality of bent fingers is formed in the base of the shielding plate for electrically contacting an external metal shell.

2. An electrical card connector comprising:

a header enclosing a plurality of terminals therein, and a pair of receiving holes at two opposite ends thereof; and a shielding plate including a horizontally extending base with a plurality of grounding fingers upwardly extending therefrom and a pair of lengthened locking arms extending downwardly and vertically from two opposite ends thereof, said locking arms respectively extending through the corresponding receiving holes and folded to horizontally extend toward each other and extend over substantially the entire length of a lower side of the header to enclose the terminals.

3. A method for making an electrical card connector, comprising steps of:

providing a header with a plurality of terminals therein;

defining a pair of receiving holes at two opposite ends of the header; providing a shielding plate by stamping, said shielding plate defining a base with a plurality of upwardly extending grounding fingers thereon and two downwardly extending locking arms at two opposite ends thereof;

inserting said two locking arms into the corresponding receiving holes; and bending said two locking arms horizontally toward each other to extend over substantially an entire side of the header for cooperating with the base to enclose said terminals.

* * * * *